US011530695B1

(12) United States Patent
Hahn

(10) Patent No.: US 11,530,695 B1
(45) Date of Patent: Dec. 20, 2022

(54) SUCTION MUFFLER FOR A RECIPROCATING COMPRESSOR

(71) Applicant: Haier US Appliance Solutions, Inc., Wilmington, DE (US)

(72) Inventor: Gregory William Hahn, Mt. Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/365,882

(22) Filed: Jul. 1, 2021

(51) Int. Cl.
*F04B 39/00* (2006.01)
*F04B 35/04* (2006.01)

(52) U.S. Cl.
CPC ..... *F04B 39/0027* (2013.01); *F04B 35/04* (2013.01)

(58) Field of Classification Search
CPC ..... F04B 39/0027; F04B 35/04
See application file for complete search history.

(56) References Cited

U.S. PATENT DOCUMENTS

| | | | | |
|---|---|---|---|---|
| 5,993,178 | A | 11/1999 | Ha | |
| 6,174,141 | B1 | 1/2001 | Hyung-Jin | |
| 6,398,523 | B1 | 6/2002 | Hur | |
| 6,422,833 | B1 * | 7/2002 | Park | F04B 39/0027 417/415 |
| 6,446,454 | B1 | 9/2002 | Hyup | |
| 6,860,725 | B2 | 3/2005 | Kyung-Seok | |
| 7,025,575 | B2 | 4/2006 | Jik | |
| 7,150,605 | B2 | 12/2006 | Kim | |
| 7,306,438 | B2 | 12/2007 | Seong-Yeol | |
| 7,478,996 | B2 | 1/2009 | Kang | |
| 7,626,289 | B2 | 12/2009 | Her | |
| 7,921,845 | B2 | 4/2011 | Kim | |
| 8,303,273 | B2 | 11/2012 | Young-Hoan | |
| 8,317,495 | B2 | 11/2012 | Young-Hoan | |
| 8,366,415 | B2 | 2/2013 | Young-Hoan | |
| 8,496,453 | B2 | 7/2013 | Young-Hoan | |
| 8,561,521 | B2 | 10/2013 | Young-Hoan | |
| 8,651,834 | B2 | 2/2014 | Seong-Yeol | |
| 8,747,081 | B2 | 6/2014 | Young-Hoan | |
| 9,353,773 | B2 | 5/2016 | Lilie | |
| 9,714,648 | B2 | 7/2017 | Sangsub | |
| 10,012,222 | B2 | 7/2018 | Lilie | |
| 10,066,615 | B2 | 9/2018 | Hahn | |

(Continued)

FOREIGN PATENT DOCUMENTS

| | | | |
|---|---|---|---|
| KR | 100480089 | B1 | 6/2005 |
| KR | 20090041729 | A | 4/2009 |

(Continued)

*Primary Examiner* — Joseph J Dallo
(74) *Attorney, Agent, or Firm* — Dority & Manning, P.A.

(57) ABSTRACT

A reciprocating compressor includes a piston slidably mounted within a compression chamber and defining a suction port for receiving a flow of gas. A flex mount is mechanically coupled to the piston and has an inner surface that defines a suction cavity. A suction muffler is positioned at least partially within the suction cavity and includes an inlet tube extending along the axial direction within the suction cavity and defining an inlet passageway configured to receive the flow of gas and a plurality of chamber plates that extend along the radial direction from an outer surface of the inlet tube, the plurality of chamber plates and the flex mount defining a plurality of resonance chambers to reduce compressor noise.

20 Claims, 10 Drawing Sheets

(56) References Cited

U.S. PATENT DOCUMENTS

| | | | | |
|---|---|---|---|---|
| 10,113,540 | B2 | 10/2018 | Barito | |
| 10,267,302 | B2 | 4/2019 | Kyoungseok | |
| 10,465,671 | B2 | 11/2019 | Hahn | |
| 10,495,081 | B2 | 12/2019 | Kichul | |
| 10,746,164 | B2 | 8/2020 | Hahn | |
| 2004/0247457 | A1 | 12/2004 | Kim | |
| 2005/0053479 | A1 | 3/2005 | Chui | |
| 2005/0175473 | A1 | 8/2005 | Park | |
| 2006/0153712 | A1 | 7/2006 | Park | |
| 2011/0250083 | A1* | 10/2011 | Park | F04B 39/0027 417/420 |
| 2014/0322040 | A1* | 10/2014 | Cho | F04B 39/0061 417/312 |
| 2015/0078925 | A1 | 3/2015 | Kwangwoon | |
| 2015/0300340 | A1* | 10/2015 | Ishida | F04B 39/0276 184/5 |
| 2015/0377531 | A1 | 12/2015 | Youngcheol | |
| 2016/0131123 | A1* | 5/2016 | Kim | F04B 39/123 417/312 |
| 2018/0135612 | A1 | 5/2018 | Bae | |
| 2018/0187666 | A1 | 7/2018 | Ahn | |
| 2019/0219312 | A1 | 7/2019 | Jonghun | |
| 2019/0264668 | A1 | 8/2019 | Kim | |
| 2019/0345924 | A1 | 11/2019 | Hahn | |
| 2020/0025186 | A1 | 1/2020 | Sanga | |
| 2020/0025187 | A1 | 1/2020 | Sanga | |

FOREIGN PATENT DOCUMENTS

| | | | | |
|---|---|---|---|---|
| WO | WO2007046594 | A1 | 4/2007 | |
| WO | WO2007046610 | A1 | 4/2007 | |
| WO | WO-2018212452 | A1 * | 11/2018 | F04B 35/04 |

* cited by examiner

SUCTION MUFFLER FOR A RECIPROCATING COMPRESSOR

FIELD OF THE INVENTION

The present subject matter relates generally to reciprocating compressors, and more particularly, to suction mufflers for use in reciprocating compressors.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein. Recently, certain refrigerator appliances have included reciprocating compressors, such as linear compressors, for compressing refrigerant. Linear compressors generally include a piston and a driving coil. The driving coil generates a force for sliding the piston forward and backward within a chamber. During motion of the piston within the chamber, the piston compresses refrigerant.

Reciprocating compressors typically include a one-way valve that permits a flow of gas into a compression chamber as the piston moves into a retracted position during an intake stroke and prevents the gas from escaping the compression chamber as the piston moves into an extended position during a compression stroke. For example, the valve may include a flapper valve mounted to a compression face of the piston. The flapper valve may be thin enough to bend under the force of gas pressure from an intake conduit. Notably, the constant opening and closing of the suction valve can generate significant noise. Conventional reciprocating compressors may include mufflers to reduce noise from suction valve pulsation, but these mufflers are complicated to install, may be ineffective at reducing noise, and can harm compressor efficiency.

Accordingly, a reciprocating compressor with features for improved noise reduction would be desirable. More particularly, a reciprocating compressor with a suction muffler that is easy to install and effectively reduces compressor noise without harming compressor performance would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a reciprocating compressor defining an axial direction and a radial direction is provided. The reciprocating compressor includes a cylindrical casing defining a compression chamber, a piston positioned within the compression chamber and being movable along the axial direction, the piston defining a suction port for receiving a flow of gas, a flex mount mechanically coupled to the piston, the flex mount having an inner surface that defines a suction cavity, and a suction muffler positioned at least partially within the suction cavity of the flex mount. The suction muffler includes an inlet tube extending along the axial direction within the suction cavity and defining an inlet passageway configured to receive the flow of gas and a plurality of chamber plates that extend along the radial direction from an outer surface of the inlet tube, the plurality of chamber plates and the flex mount defining a plurality of resonance chambers.

In another exemplary embodiment, a suction muffler for a reciprocating compressor is provided. The reciprocating compressor defines an axial direction and a radial direction, the reciprocating compressor including a piston positioned within a compression chamber, a flex mount mechanically coupled to a piston and having an inner surface that defines a suction cavity and a locking flange that extends from the inner surface of the flex mount toward the suction muffler along the radial direction. The suction muffler includes an inlet tube extending along the axial direction within the suction cavity and defining an inlet passageway configured to receive a flow of gas, a plurality of chamber plates that extend along the radial direction from an outer surface of the inlet tube, the plurality of chamber plates and the flex mount defining a plurality of resonance chambers, and a latching feature that engages the locking flange to secure the suction muffler within the suction cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
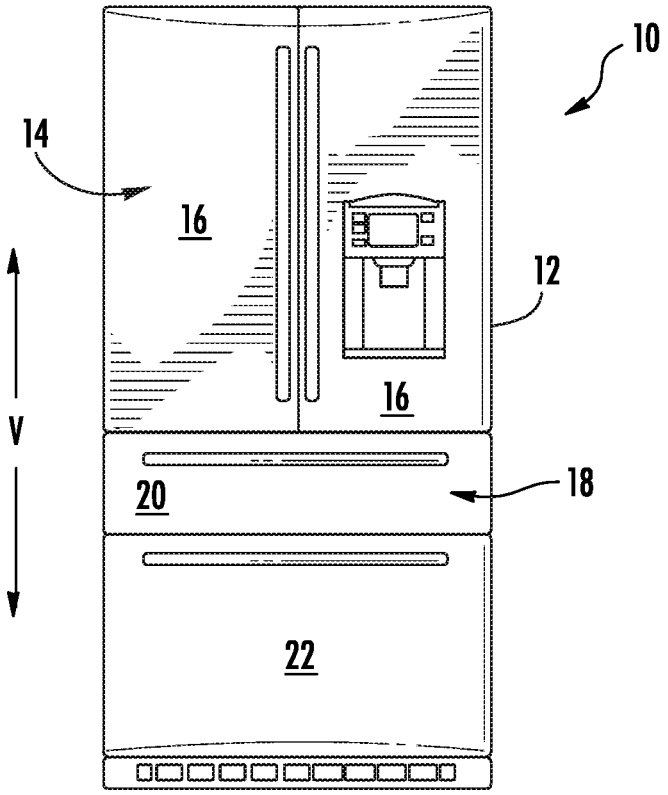
FIG. 1 is a front elevation view of a refrigerator appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
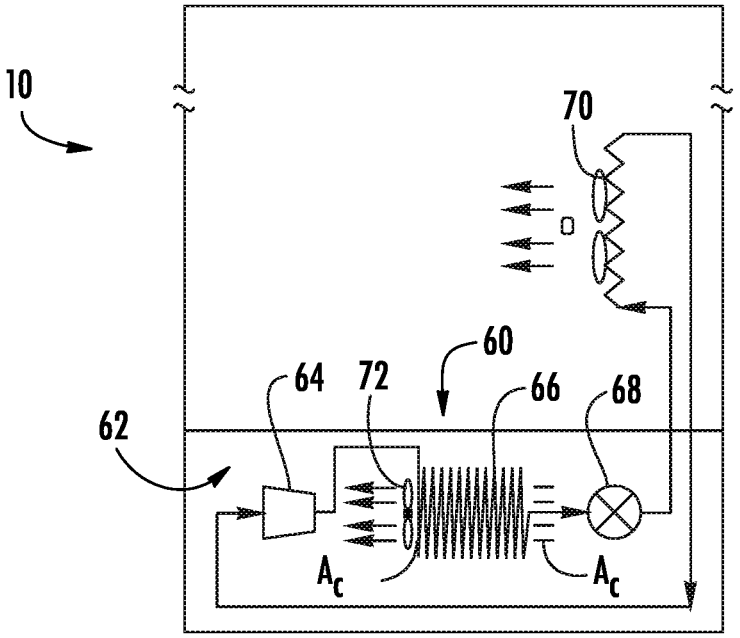
FIG. 2 is schematic view of certain components of the example refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated example embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device 68 (e.g., a valve, capillary tube, or other restriction device) receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well. Furthermore, it should be appreciated that terms such as "refrigerant," "gas," "fluid," and the like are generally intended to refer to a motive fluid for facilitating the operation of refrigeration system 60, and may include, fluid, liquid, gas, or any combination thereof in any state.

Figure 3:
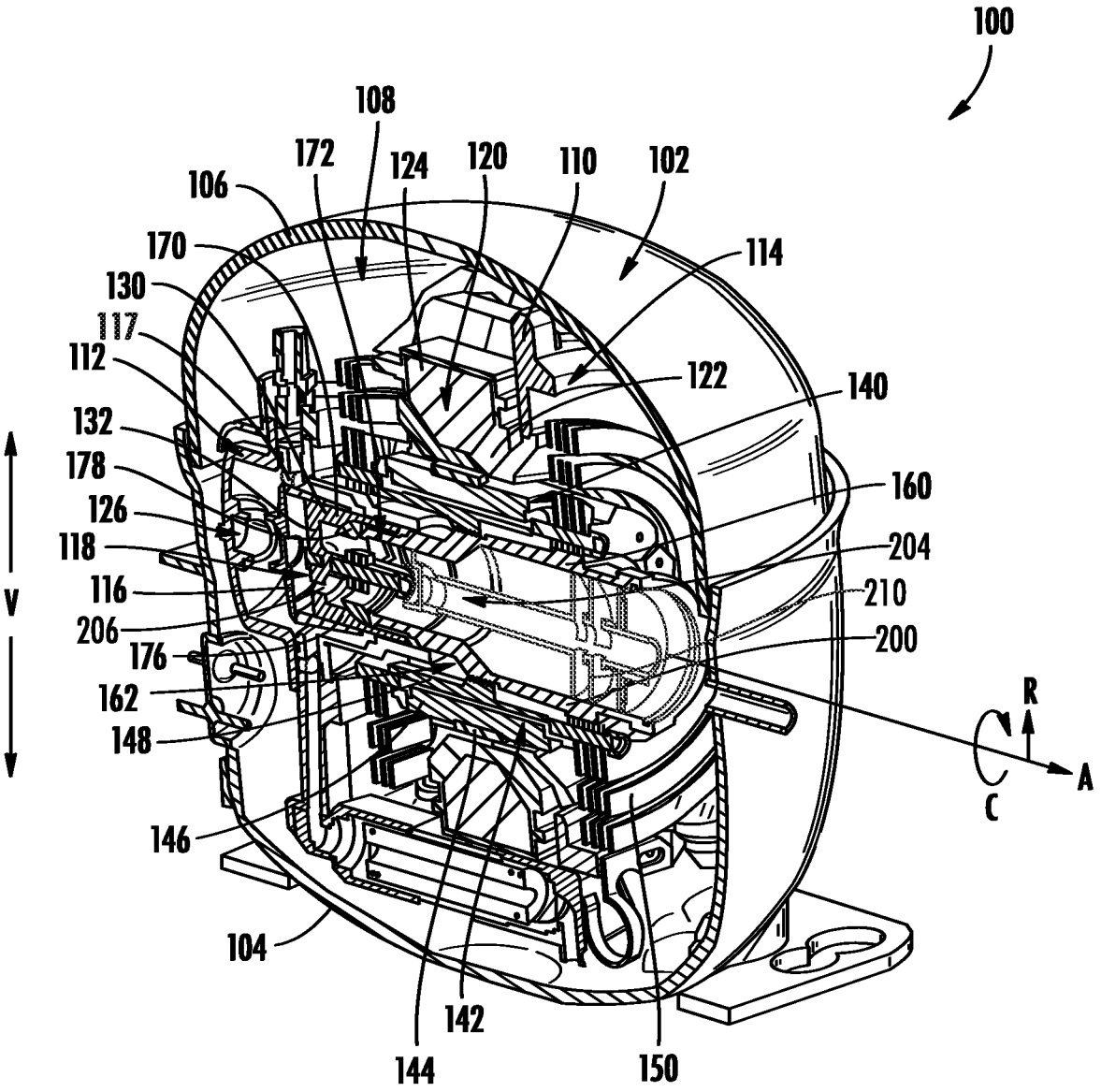
FIG. 3 is a perspective, section view of a linear compressor according to an exemplary embodiment of the present subject matter.
Figure 4:
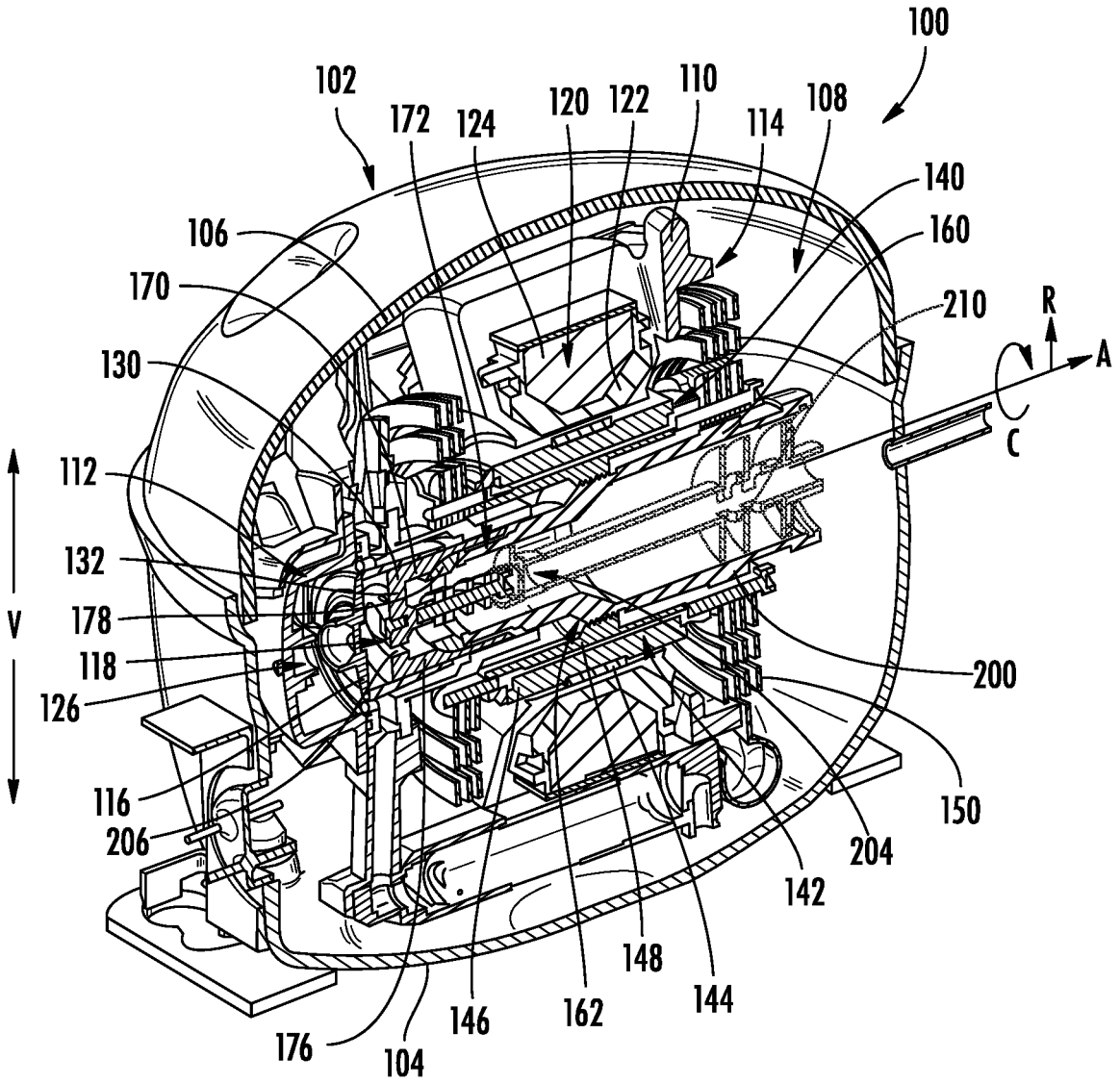
FIG. 4 is another perspective, section view of the exemplary linear compressor of FIG. 3 according to an exemplary embodiment of the present subject matter.
Figure 5:
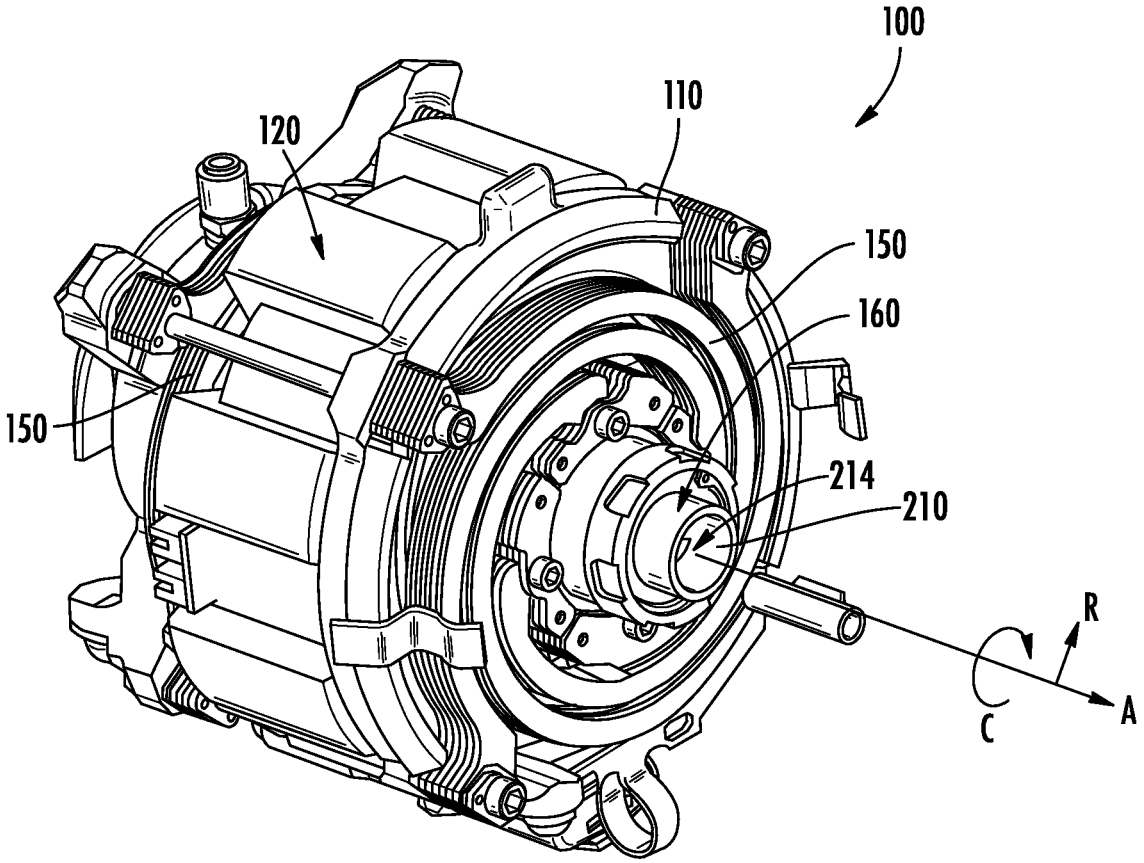
FIG. 5 is a perspective view of a linear compressor with a compressor housing removed for clarity according to an example embodiment of the present subject matter.
Figure 6:
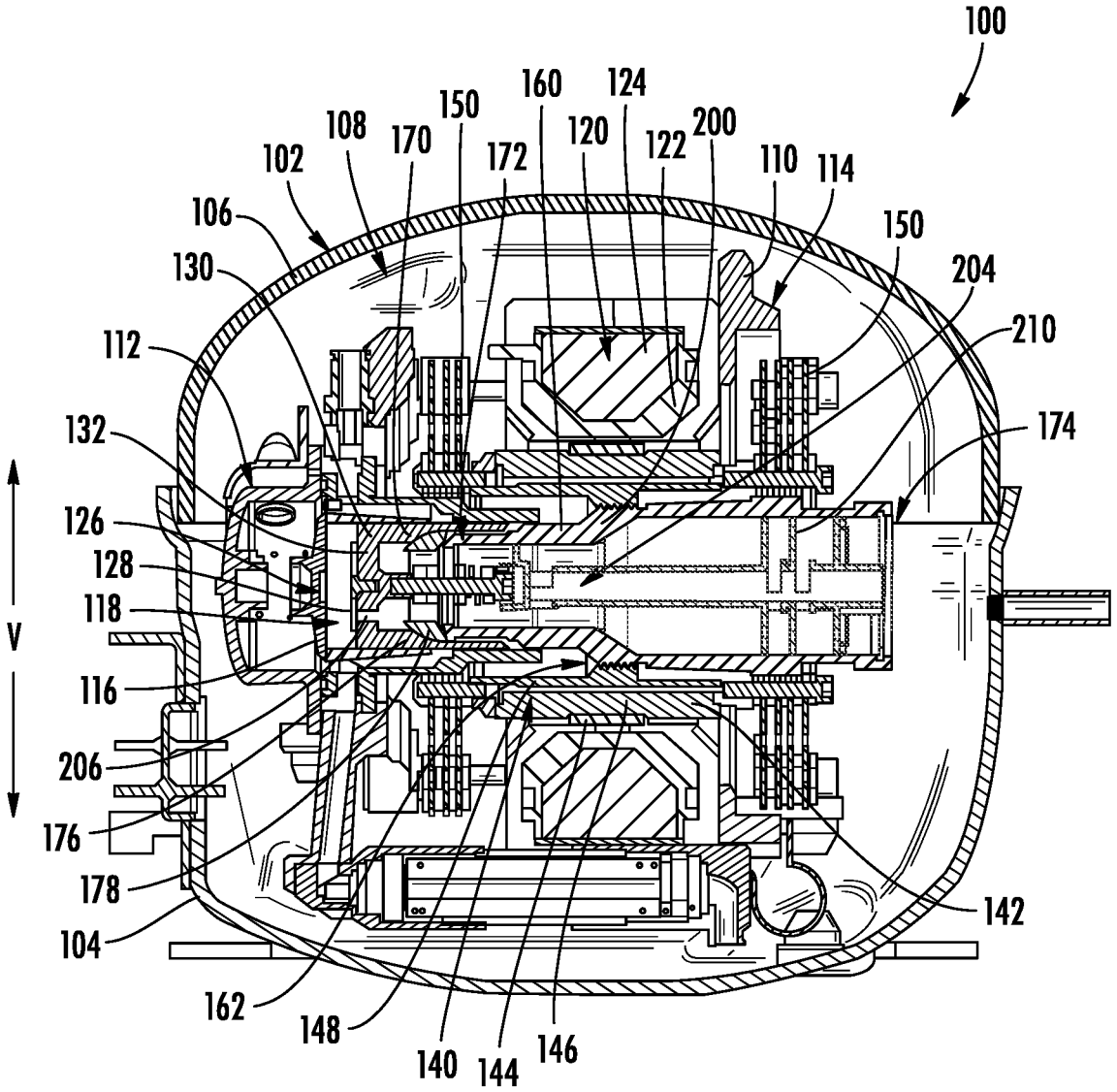
FIG. 6 is a section view of the exemplary linear compressor of FIG. 3 with a piston in an extended position according to an exemplary embodiment of the present subject matter.
Figure 7:
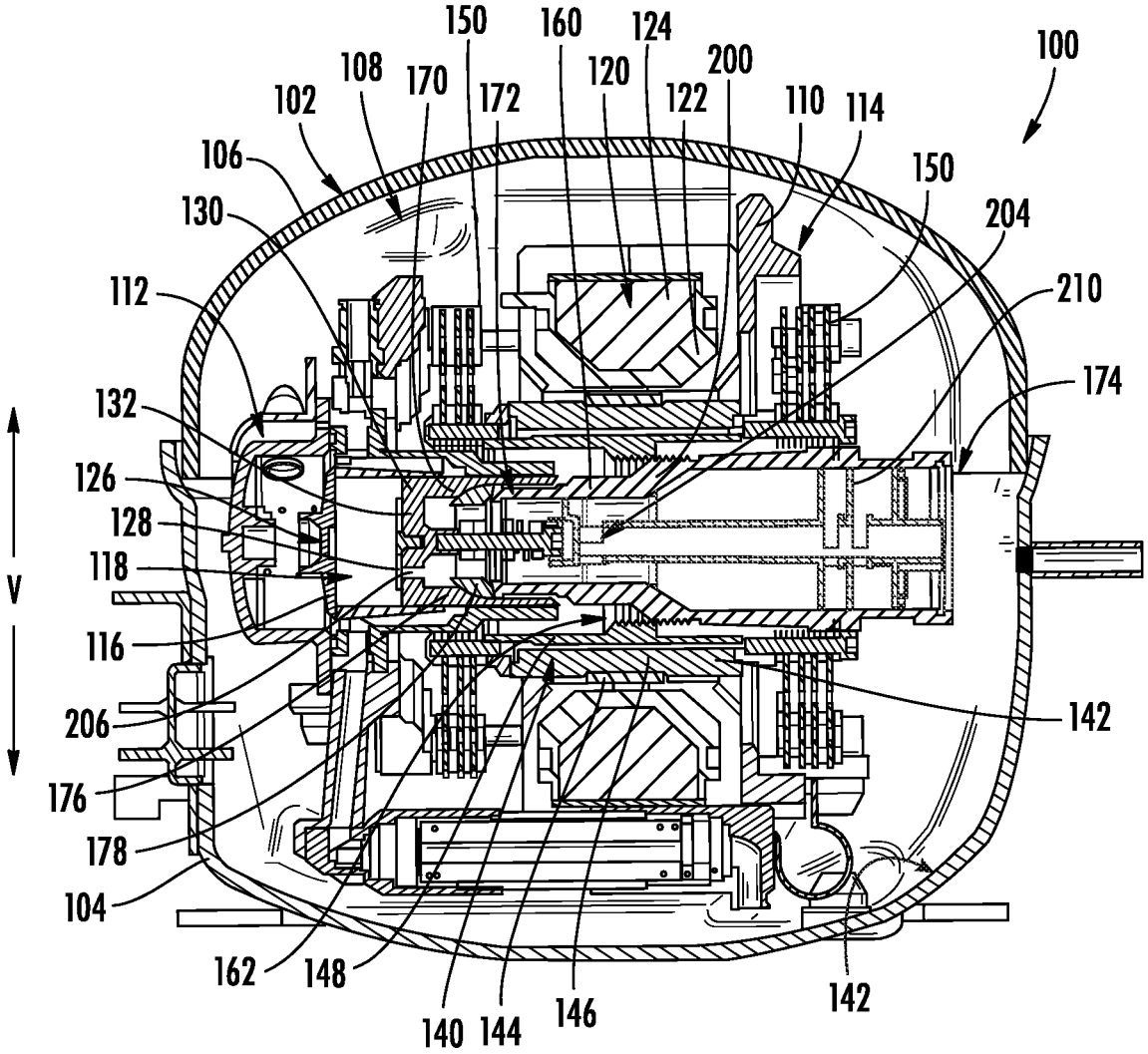
FIG. 7 is a section view of the exemplary linear compressor of FIG. 3 with the piston in a retracted position according to an exemplary embodiment of the present subject matter.

Referring now generally to FIGS. 3 through 7, a linear compressor 100 will be described according to exemplary embodiments of the present subject matter. Specifically, FIGS. 3 and 4 provide perspective, section views of linear compressor 100, FIG. 5 provides a perspective view of linear compressor 100 with a compressor shell or housing 102 removed for clarity, and FIGS. 6 and 7 provide section views of linear compressor when a piston is in an extended and retracted position, respectively. It should be appreciated that linear compressor 100 is used herein only as an exemplary embodiment to facilitate the description of aspects of the present subject matter. Modifications and variations may be made to linear compressor 100 while remaining within the scope of the present subject matter. Indeed, aspects of the present subject matter are applicable to any suitable piston-actuated or reciprocating compressor.

As illustrated for example in FIGS. 3 and 4, housing 102 may include a lower portion or lower housing 104 and an upper portion or upper housing 106 which are joined together to form a substantially enclosed cavity 108 for housing various components of linear compressor 100. Specifically, for example, cavity 108 may be a hermetic or air-tight shell that can house working components of linear compressor 100 and may hinder or prevent refrigerant from leaking or escaping from refrigeration system 60. In addition, linear compressor 100 generally defines an axial direction A, a radial direction R, and a circumferential direction C. It should be appreciated that linear compressor 100 is described and illustrated herein only to describe aspects of the present subject matter. Variations and modifications to linear compressor 100 may be made while remaining within the scope of the present subject matter.

Referring now generally to FIGS. 3 through 7, various parts and working components of linear compressor 100 will be described according to an exemplary embodiment. As shown, linear compressor 100 includes a casing 110 that extends between a first end portion 112 and a second end portion 114, e.g., along the axial direction A. Casing 110 includes a cylinder 117 that defines a chamber 118. Cylinder 117 is positioned at or adjacent first end portion 112 of casing 110. Chamber 118 extends longitudinally along the axial direction A. As discussed in greater detail below, linear compressor 100 is operable to increase a pressure of fluid within chamber 118 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2).

Linear compressor 100 includes a stator 120 of a motor that is mounted or secured to casing 110. For example, stator 120 generally includes an outer back iron 122 and a driving coil 124 that extend about the circumferential direction C within casing 110. Linear compressor 100 also includes one or more valves that permit refrigerant to enter and exit chamber 118 during operation of linear compressor 100. For example, a discharge muffler 126 is positioned at an end of chamber 118 for regulating the flow of refrigerant out of chamber 118, while a suction valve 128 (shown only in FIGS. 6-7 for clarity) regulates flow of refrigerant into chamber 118.

A piston 130 with a piston head 132 is slidably received within chamber 118 of cylinder 117. In particular, piston 130 is slidable along the axial direction A. During sliding of piston head 132 within chamber 118, piston head 132 compresses refrigerant within chamber 118. As an example, from a top dead center position (see, e.g., FIG. 6), piston head 132 can slide within chamber 118 towards a bottom dead center position (see, e.g., FIG. 7) along the axial direction A, i.e., an expansion stroke of piston head 132. When piston head 132 reaches the bottom dead center position, piston head 132 changes directions and slides in chamber 118 back towards the top dead center position, i.e., a compression stroke of piston head 132. It should be understood that linear compressor 100 may include an additional piston head and/or additional chambers at an opposite end of linear compressor 100. Thus, linear compressor 100 may have multiple piston heads in alternative exemplary embodiments.

As illustrated, linear compressor 100 also includes a mover 140 which is generally driven by stator 120 for compressing refrigerant. Specifically, for example, mover 140 may include an inner back iron 142 positioned in stator 120 of the motor. In particular, outer back iron 122 and/or driving coil 124 may extend about inner back iron 142, e.g., along the circumferential direction C. Inner back iron 142 also has an outer surface that faces towards outer back iron 122 and/or driving coil 124. At least one driving magnet 144 is mounted to inner back iron 142, e.g., at the outer surface of inner back iron 142.

Driving magnet 144 may face and/or be exposed to driving coil 124. In particular, driving magnet 144 may be spaced apart from driving coil 124, e.g., along the radial direction R by an air gap. Thus, the air gap may be defined between opposing surfaces of driving magnet 144 and driving coil 124. Driving magnet 144 may also be mounted or fixed to inner back iron 142 such that an outer surface of driving magnet 144 is substantially flush with the outer surface of inner back iron 142. Thus, driving magnet 144 may be inset within inner back iron 142. In such a manner, the magnetic field from driving coil 124 may have to pass through only a single air gap between outer back iron 122 and inner back iron 142 during operation of linear compressor 100, and linear compressor 100 may be more efficient relative to linear compressors with air gaps on both sides of a driving magnet.

As may be seen in FIG. 3, driving coil 124 extends about inner back iron 142, e.g., along the circumferential direction C. In alternative example embodiments, inner back iron 142 may extend around driving coil 124 along the circumferential direction C. Driving coil 124 is operable to move the inner back iron 142 along the axial direction A during operation of driving coil 124. As an example, a current may be induced within driving coil 124 by a current source (not shown) to generate a magnetic field that engages driving magnet 144 and urges piston 130 to move along the axial direction A in order to compress refrigerant within chamber 118 as described above and will be understood by those skilled in the art. In particular, the magnetic field of driving coil 124 may engage driving magnet 144 in order to move inner back iron 142 and piston head 132 along the axial direction A during operation of driving coil 124. Thus, driving coil 124 may slide piston 130 between the top dead center position and the bottom dead center position, e.g., by moving inner back iron 142 along the axial direction A, during operation of driving coil 124.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 124 of the motor. Thus, the controller may selectively activate driving coil 124, e.g., by inducing current in driving coil 124, in order to compress refrigerant with piston 130 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Inner back iron 142 further includes an outer cylinder 146 and an inner sleeve 148. Outer cylinder 146 defines the outer surface of inner back iron 142 and also has an inner surface positioned opposite the outer surface of outer cylinder 146. Inner sleeve 148 is positioned on or at inner surface of outer cylinder 146. A first interference fit between outer cylinder 146 and inner sleeve 148 may couple or secure outer cylinder 146 and inner sleeve 148 together. In alternative exemplary embodiments, inner sleeve 148 may be welded, glued, fastened, or connected via any other suitable mechanism or method to outer cylinder 146.

Outer cylinder 146 may be constructed of or with any suitable material. For example, outer cylinder 146 may be constructed of or with a plurality of (e.g., ferromagnetic) laminations. The laminations are distributed along the circumferential direction C in order to form outer cylinder 146 and are mounted to one another or secured together, e.g., with rings pressed onto ends of the laminations. Outer cylinder 146 may define a recess that extends inwardly from the outer surface of outer cylinder 146, e.g., along the radial direction R. Driving magnet 144 is positioned in the recess on outer cylinder 146, e.g., such that driving magnet 144 is inset within outer cylinder 146.

Linear compressor 100 also includes a pair of planar springs 150. Each planar spring 150 may be coupled to a respective end of inner back iron 142, e.g., along the axial direction A. During operation of driving coil 124, planar springs 150 support inner back iron 142. In particular, inner back iron 142 is suspended by planar springs 150 within the stator or the motor of linear compressor 100 such that motion of inner back iron 142 along the radial direction R is hindered or limited while motion along the axial direction A is relatively unimpeded. Thus, planar springs 150 may be substantially stiffer along the radial direction R than along the axial direction A. In such a manner, planar springs 150 can assist with maintaining a uniformity of the air gap between driving magnet 144 and driving coil 124, e.g., along the radial direction R, during operation of the motor and movement of inner back iron 142 on the axial direction A. Planar springs 150 can also assist with hindering side pull forces of the motor from transmitting to piston 130 and being reacted in cylinder 117 as a friction loss.

A flex mount 160 is mounted to and extends through inner back iron 142. In particular, flex mount 160 is mounted to inner back iron 142 via inner sleeve 148. Thus, flex mount 160 may be coupled (e.g., threaded) to inner sleeve 148 at the middle portion of inner sleeve 148 and/or flex mount 160 in order to mount or fix flex mount 160 to inner sleeve 148. Flex mount 160 may assist with forming a coupling 162. Coupling 162 connects inner back iron 142 and piston 130 such that motion of inner back iron 142, e.g., along the axial direction A, is transferred to piston 130.

Coupling 162 may be a compliant coupling that is compliant or flexible along the radial direction R. In particular, coupling 162 may be sufficiently compliant along the radial direction R such that little or no motion of inner back iron 142 along the radial direction R is transferred to piston 130 by coupling 162. In such a manner, side pull forces of the motor are decoupled from piston 130 and/or cylinder 117 and friction between piston 130 and cylinder 117 may be reduced.

As may be seen in the figures, piston head 132 of piston 130 has a piston cylindrical side wall 170. Cylindrical side wall 170 may extend along the axial direction A from piston head 132 towards inner back iron 142. An outer surface of cylindrical side wall 170 may slide on cylinder 117 at chamber 118 and an inner surface of cylindrical side wall 170 may be positioned opposite the outer surface of cylindrical side wall 170. Thus, the outer surface of cylindrical side wall 170 may face away from a center of cylindrical side wall 170 along the radial direction R, and the inner surface of cylindrical side wall 170 may face towards the center of cylindrical side wall 170 along the radial direction R.

Flex mount 160 extends between a first end portion 172 and a second end portion 174, e.g., along the axial direction A. According to an exemplary embodiment, the inner surface of cylindrical side wall 170 defines a ball seat 176 proximate first end portion. In addition, coupling 162 also includes a ball nose 178. Specifically, for example, ball nose 178 is positioned at first end portion 172 of flex mount 160, and ball nose 178 may contact flex mount 160 at first end portion 172 of flex mount 160. In addition, ball nose 178 may contact piston 130 at ball seat 176 of piston 130. In particular, ball nose 178 may rest on ball seat 176 of piston 130 such that ball nose 178 is slidable and/or rotatable on ball seat 176 of piston 130. For example, ball nose 178 may have a frusto-spherical surface positioned against ball seat 176 of piston 130, and ball seat 176 may be shaped complementary to the frusto-spherical surface of ball nose 178. The frusto-spherical surface of ball nose 178 may slide and/or rotate on ball seat 176 of piston 130.

Relative motion between flex mount 160 and piston 130 at the interface between ball nose 178 and ball seat 176 of piston 130 may provide reduced friction between piston 130 and cylinder 117, e.g., compared to a fixed connection between flex mount 160 and piston 130. For example, when an axis on which piston 130 slides within cylinder 117 is angled relative to the axis on which inner back iron 142 reciprocates, the frusto-spherical surface of ball nose 178 may slide on ball seat 176 of piston 130 to reduce friction between piston 130 and cylinder 117 relative to a rigid connection between inner back iron 142 and piston 130.

Flex mount 160 is connected to inner back iron 142 away from first end portion 172 of flex mount 160. For example, flex mount 160 may be connected to inner back iron 142 at second end portion 174 of flex mount 160 or between first and second end portions 172, 174 of flex mount 160. Conversely, flex mount 160 is positioned at or within piston 130 at first end portion 172 of flex mount 160, as discussed in greater detail below.

Referring now also to FIGS. 8 through 13, flex mount 160 and an internal muffler will be described in more detail according to exemplary embodiments of the present subject matter. In this regard, for example, flex mount 160 includes a tubular wall 200 that is positioned between and mechanically couples inner back iron 142 and piston 130. In addition, tubular wall 200 has an inner surface 202 that defines a suction cavity 204 that is generally configured for receiving and directing compressible fluid, such as refrigerant or air (identified below and in FIG. 9 as flow of gas 238), through flex mount 160 towards piston head 132 and/or piston 130.

Inner back iron 142 may be mounted to flex mount 160 such that inner back iron 142 extends around tubular wall 200, e.g., at the middle portion of flex mount 160 between first and second end portions 172, 174 of flex mount 160. Suction cavity 204 may extend between first and second end portions 172, 174 of flex mount 160 within tubular wall 200 such that the compressible fluid is flowable from second end portion 174 of flex mount 160 (e.g., a gas inlet) to first end portion 172 of flex mount 160 (e.g., a gas outlet) through suction cavity 204. In such a manner, compressible fluid may flow through inner back iron 142 within flex mount 160 during operation of linear compressor 100.

Piston head 132 also defines at least one opening 206. Opening 206 of piston head 132 extends, e.g., along the axial direction A, through piston head 132. Thus, the flow of fluid may pass through piston head 132 via opening 206 of piston head 132 into chamber 118 during operation of linear compressor 100. In such a manner, the flow of fluid (that is compressed by piston head 132 within chamber 118) may flow within suction cavity 204 through flex mount 160 and inner back iron 142 to piston 130 during operation of linear compressor 100. As explained above, suction valve 128 (FIGS. 6-7) may be positioned on piston head 132 to regulate the flow of compressible fluid through opening 206 into chamber 118.

As best illustrated in FIGS. 3-4 and 6-13, linear compressor 100 may further include a suction muffler 210 that is positioned at least partially within suction cavity 204 within tubular wall 200, e.g., to reduce the noise generated during the operation of linear compressor 100. In this regard, for example, suction valve 128 may generate a popping noise every time it is opened or closed. Suction muffler 210 may be designed for damping such compressor noise. In addition, or alternatively, suction muffler 210 generally be configured for reducing noise generated by compressible fluid flowing through suction cavity 204 or any other noises generated during operation of linear compressor 100.

As mentioned briefly above, suction muffler 210 may be generally positioned at least partially within suction cavity 204 of flex mount 160. Suction muffler 210 may include an inlet tube 212 that extends substantially along the axial direction A within suction cavity 204, e.g., in a manner coaxial with tubular wall 200 of flex mount 160. Inlet tube 212 may generally define and internal inlet passageway 214 that is configured for receiving a flow of gas from second end of portion 174 and directing the flow of gas toward first end portion 172 and into chamber 118 through opening 206 in piston head 132. Notably, inlet passageway 214 may be designed to have a sufficient cross sectional flow area so as to not restrict the flow of gas through flex mount 160 and piston head 132. Accordingly, the presence of suction muffler 210 may have little or no negative effect on the efficiency and performance of linear compressor 100.

Figure 9:
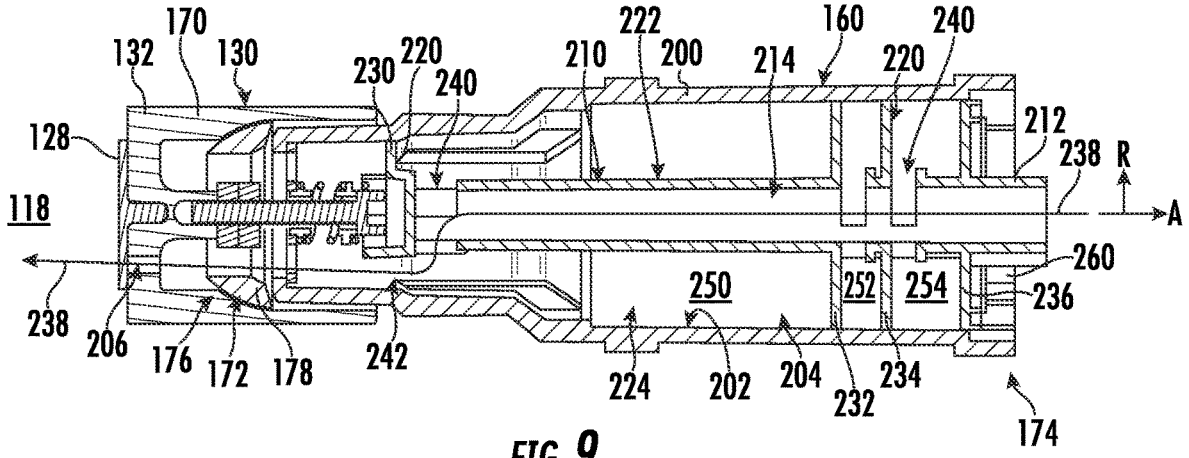
FIG. 9 is a cross-sectional view of the exemplary piston, flex mount, and suction muffler of FIG. 8 according to an exemplary embodiment of the present subject matter.
Figure 10:
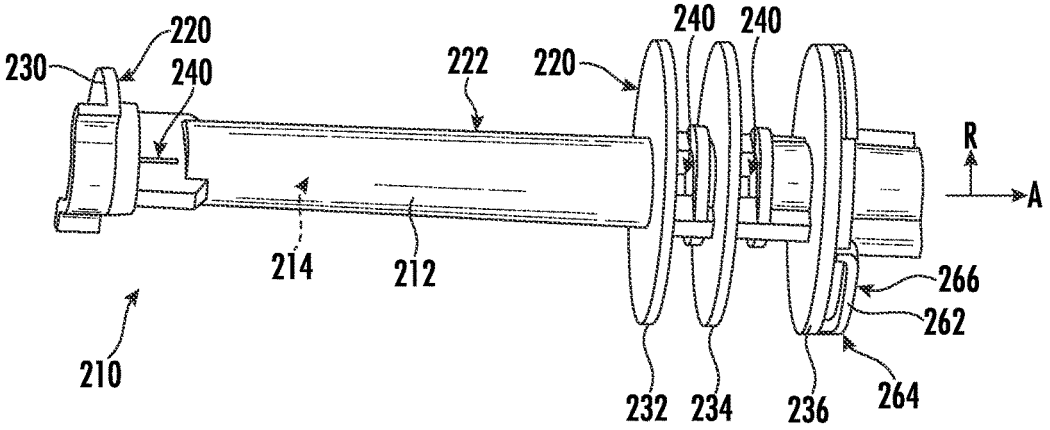
FIG. 10 provides a perspective view of the exemplary suction muffler of FIG. 8 according to an exemplary embodiment of the present subject matter.
Figure 11:
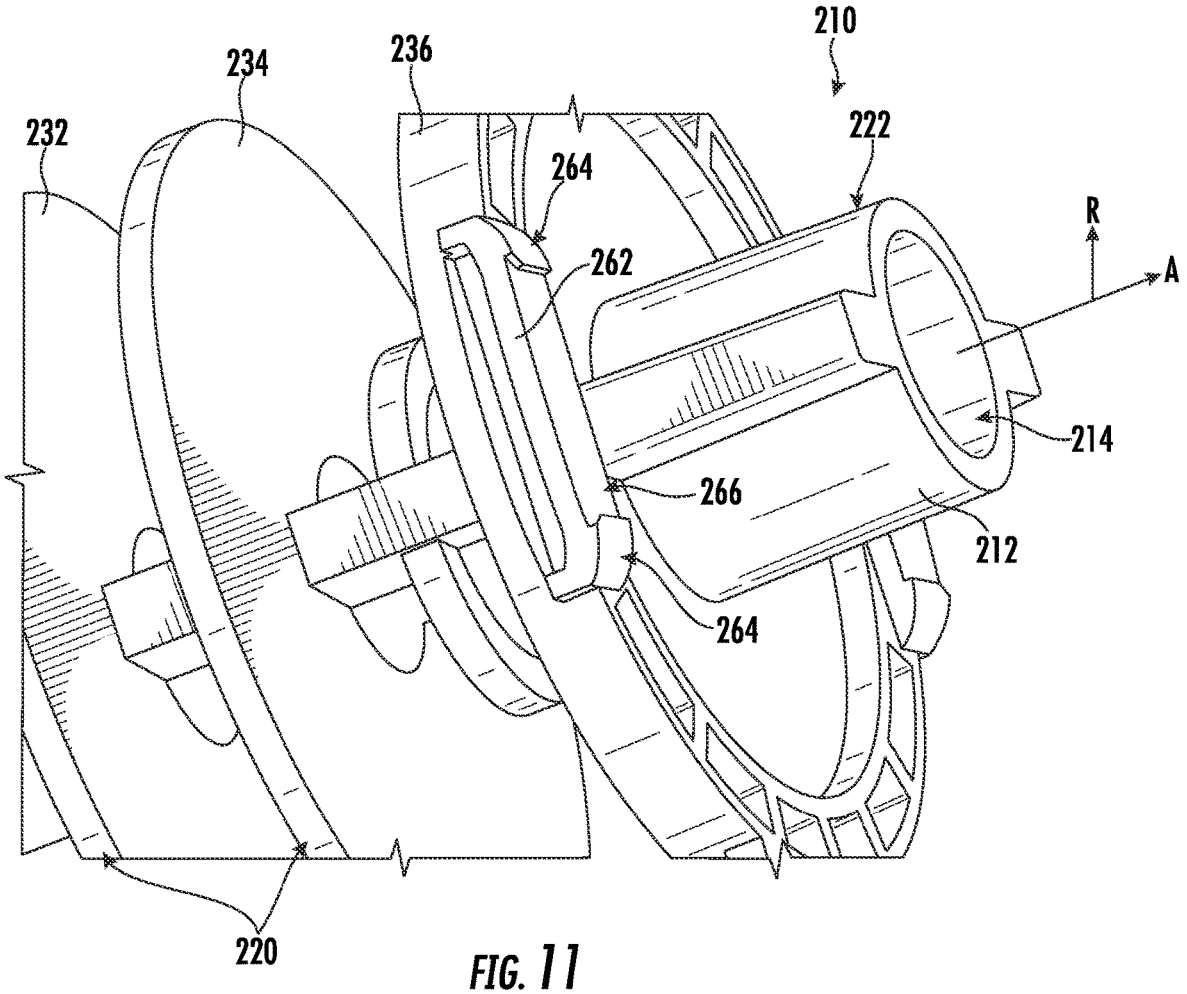
FIG. 11 provides a close-up perspective view of a latching feature of the exemplary suction muffler of FIG. 8 according to an exemplary embodiment of the present subject matter.
Figure 12:
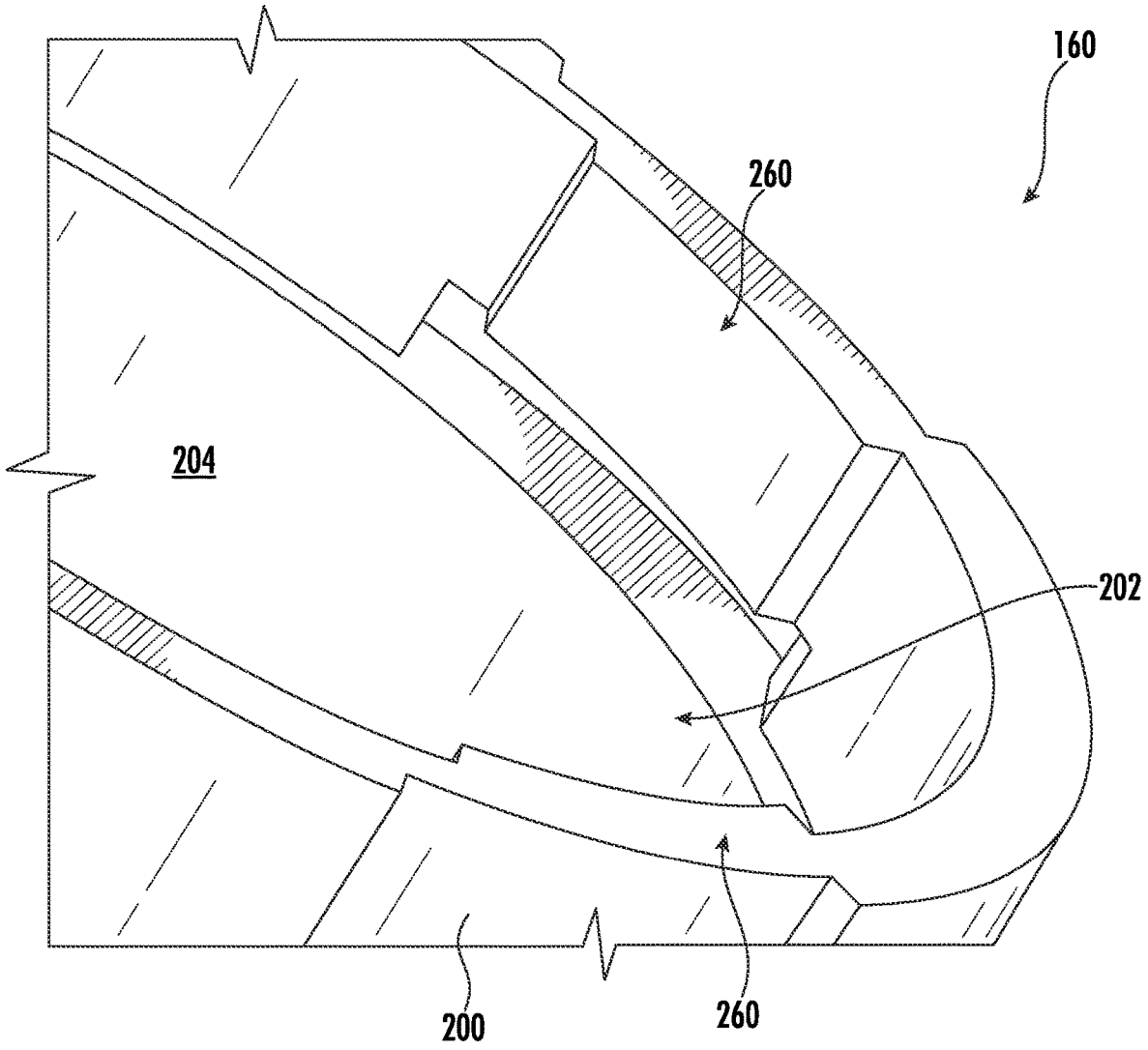
FIG. 12 provides a close-up perspective view of a locking flange of the exemplary flex mount of FIG. 8 according to an exemplary embodiment of the present subject matter.
Figure 13:
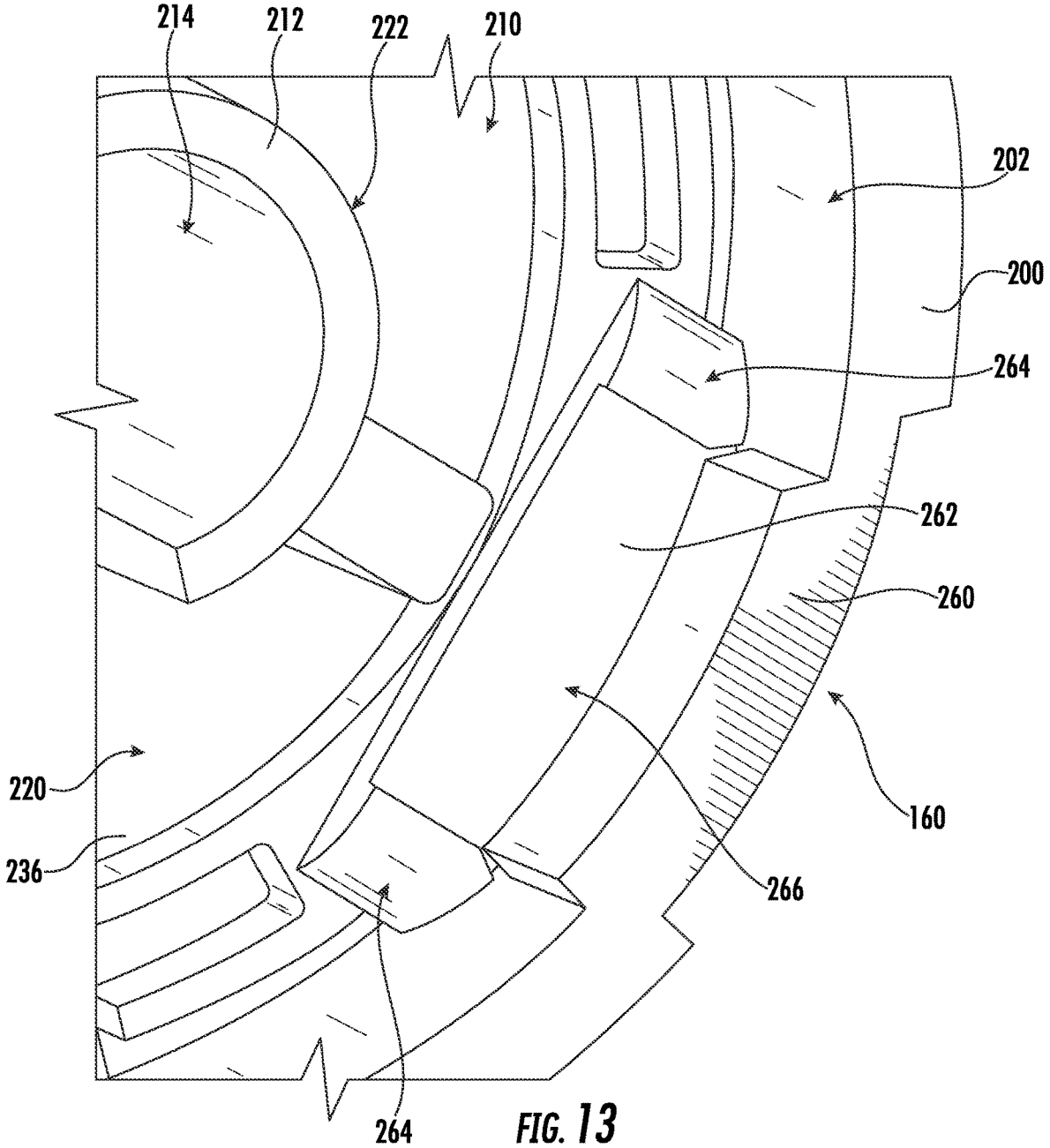
FIG. 13 illustrated a latching feature of the suction muffler engaging a locking flange of the flex mount according to an exemplary embodiment of the present subject matter.

In addition, suction muffler 210 may generally include a plurality of chamber plates (e.g., identified herein generally by reference numeral 220). As illustrated, each chamber plate 220 may extend substantially along the radial direction R outward from an outer surface 222 of inlet tube 212. Specifically, chamber plates 220 may extend from inlet tube 212 to contact inner surface 202 of tubular wall 200. For example, according to an exemplary embodiment, chamber plates 220 may form a seal against tubular wall 200 to define a plurality of resonance chambers (e.g., as identified herein generally by reference numeral 224). According to the illustrated embodiment (e.g., as best shown in FIGS. 9 and 10), suction muffler 210 includes four chamber plates 220 that are positioned and oriented for defining three resonance chambers 224, e.g., for damping three particular harmonics of compressor noise. However, it should be appreciated that according to alternative embodiments, suction muffler 210 may include any suitable number, size, and positioning of chamber plates 220 to define any suitable number of resonance chambers for damping any suitable noise generated by linear compressor 100. Accordingly, suction muffler 210 as described herein is only intended to facilitate discussion of aspects of the present subject matter and is not intended to be limiting in any manner.

Figure 8:
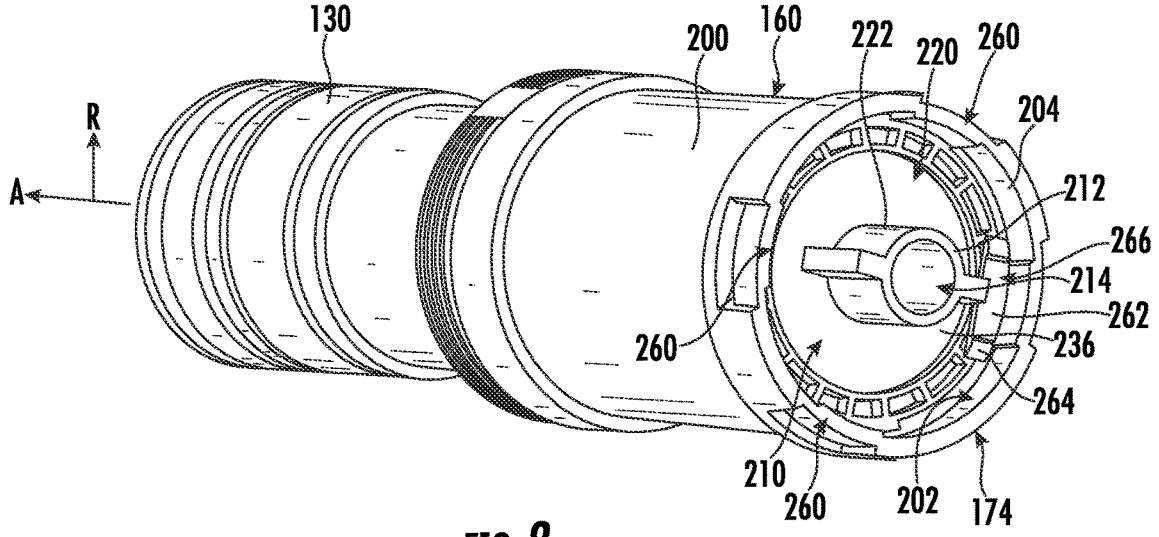
FIG. 8 provides a perspective view of a piston, a flex mount, and a suction muffler that may be used with the exemplary linear compressor of FIG. 3 according to an exemplary embodiment of the present subject matter.

Referring now specifically to FIGS. 8 through 10, an exemplary configuration of flex mount 160 and suction muffler 210 will be described according to exemplary embodiments of the present subject matter. As shown, chamber plates 220 may generally include a first chamber plate 230 positioned proximate piston head 132. In addition, plates 220 may include a second chamber plate 232, a third chamber plate 234, and a fourth chamber plate 236, each being spaced respectively further away from first chamber plate 230. In this regard, for example, fourth chamber plate 236 may be positioned adjacent second end 174 of flex mount 160 (e.g., positioned as an inlet plate). Similarly, second chamber plate 232 and third chamber plate 234 may be positioned between first chamber plate 230 and fourth chamber plate 236 along the axial direction A.

As described above, suction muffler 210 may generally be configured for receiving refrigerant gas and passing the refrigerant gas toward piston head 132 to facilitate compressor operation. Specifically, as best shown in FIG. 9, a flow of gas 238 is generally passed into inlet passageway 214 proximate fourth chamber plate 236 (e.g., inlet plate 236). The flow of gas 238 may then flow down inlet passageway 214 along the axial direction A toward piston head 132. According to the illustrated embodiment, inlet tube 212 may further define a plurality of chamber ports 240 that are defined through inlet tube 212. According to the illustrated embodiment, one chamber port 240 is positioned adjacent first chamber plate 230 and may permit the flow of gas 238 to exit inlet tube 212. In addition, first chamber plate 230 may define a suction void 242 through which the flow of gas 238 may pass toward piston 130, through opening 206 of piston head 132, and into chamber 118.

Referring still to FIG. 9, a first resonance chamber or a primary resonance chamber 250 may be defined between flex mount 160 and suction muffler 210. More specifically, primary resonance chamber 250 is defined at least in part by first chamber plate 230, second chamber plate 232, outer surface 222 of inlet tube 212, and an inner surface 202 of tubular wall 200. Similarly, an auxiliary or secondary resonance chamber 252 is defined at least in part by second chamber plate 232, third chamber plate 234, outer surface 222 of inlet tube 212, and an inner surface 202 of tubular wall 200. Another auxiliary or tertiary resonance chamber 254 is defined at least in part by third chamber plate 234, fourth chamber plate 236, outer surface 222 of inlet tube 212, and an inner surface 202 of tubular wall 200. As explained in more detail below, each of these resonance chambers 224 may be sized to have a specific length, diameter, volume, and/or cross-sectional size of chamber port 240 to facilitate noise reduction at a particular frequency or range of frequencies.

As explained above, inlet tube 212 may define a plurality of chamber ports 240, at least one of which is configured for passing the flow of gas 238 toward piston head 132. However, as illustrated in the figures, inlet tube 212 may define at least one chamber port 240 for each of the plurality of resonance chambers 224. In this regard, at least one chamber port 240 provides fluid communication between the inlet passageway 214 and each of the plurality of resonance chambers 224. Accordingly, pulsations within suction cavity 204 may propagate through inlet passageway 214 and over or into each resonance chamber 224, each of which may be configured for damping noise at a particular frequency or range of frequencies.

Accordingly, resonance chambers 224 may generally operate as Helmholtz resonators. In this regard, as is known in the art, Helmholtz resonators or oscillators are generally a container or chamber of air with a hole or neck. A Helmholtz resonant frequency may be defined by the size and dimensions of the chamber and neck of a particular chamber such that the Helmholtz resonator serves to damp noise or vibrations at that particular frequency. In other words, suction muffler 210 may be designed such that chamber plates 220 defined resonance chambers 224 that act to absorb acoustic vibrations at particular frequencies. For example, primary resonance chamber 250 may have a one-quarter wavelength Helmholtz resonator frequency tuned to the primary pulsation frequency of suction valve 128. Similarly, auxiliary resonance chamber 252 and tertiary resonance chamber 254 may be tuned to higher harmonics of noise generated by linear compressor 100.

It should be appreciated that suction muffler 210 and flex mount 160 may be formed from any suitably rigid material. For example, according to exemplary embodiments, suction muffler 210 may be formed by injection molding, e.g., using a suitable plastic material, such as injection molding grade Polybutylene Terephthalate (PBT), Nylon 6, high impact polystyrene (HIPS), or acrylonitrile butadiene styrene (ABS). Alternatively, according to the exemplary embodiment, these components may be compression molded, e.g., using sheet molding compound (SMC) thermoset plastic or other thermoplastics. According to still other embodiments, suction muffler 210 may be formed from any other suitable rigid material and/or flexible material suitable for absorbing acoustic vibrations.

Notably, it may be desirable to secure suction muffler 210 within suction cavity 204 in a manner that results in simple assembly, minimal maintenance, and little or no vibrations or movement between the two parts. Conventional mufflers are attached to linear compressor by welding or mechanical fasteners, resulting in complex assembly, the potential for weak joints, and shorter muffler lifetime. Accordingly, aspects of the present subject matter are further directed to features for quickly and securely installing suction muffler 210 within flex mount 160. Although exemplary installation features are described below, it should be appreciated that variations and modification may be made to these features while remaining within the scope of the present subject matter.

For example, as best illustrated in FIGS. 8 through 13, flex mount 160 may generally define one or more locking flanges 260 that are generally configured for engaging complementary latching features 262 defined on suction muffler 210. Specifically, according to the illustrated embodiment, flex mount 160 includes four locking flanges 260 that are spaced apart circumferentially around tubular wall 200 (e.g., one in each quadrant with circumferential voids therebetween). Similarly, suction muffler 210 defines four complementary latching features also spaced apart circumferentially around suction muffler 210, e.g., extending from fourth chamber plate 236.

In this regard, each locking flange 260 may generally extend from the inner surface 202 of tubular wall 200 toward suction muffler 210 along the radial direction R and/or latching features 262 may extend radially outward toward tubular wall 200. In this manner, a user may insert suction muffler 210 into suction cavity 204 at a first angular orientation where latching features 262 and locking flanges 260 are misaligned. The user may slide suction muffler 210 into suction cavity 204 along the axial direction A until it bottoms out within against flex mount 160 and may then rotate suction muffler 210 about the axial direction A to engage locking flanges 260 and latching features 262.

More specifically, according to the illustrated embodiment, latching feature 262 may be defined on an inlet plate of chamber plates 220, e.g., illustrated herein as fourth chamber plate 236 positioned proximate second end 174 of tubular wall 200. In addition, each latching feature 262 may extend along the axial direction away from fourth chamber plate 236 and may have a springlike structure for deflecting and snapping into place as suction muffler 210 is rotated. In this regard, for example, latching feature 262 may define a ramped surface 264 that engages locking flange 260 as suction muffler 210 is rotated. Accordingly, latching feature 262 may be deflected as suction muffler 210 is rotated until the locking flange 260 may be seated within a locking recess 266 defined by latching feature 262. Once locking flange 260 is seated within locking recess 266, suction muffler 210 may be securely fixed along the axial direction A and may be prevented from further rotation along the circumferential direction C. It should be appreciated that other latching and/or locking mechanisms are possible and within scope the present subject matter.

Aspects of the present subject matter as described above relate to a linear compressor with an integrated suction muffler in a refrigeration system. Specifically, a multi-chamber suction muffler is integrated into a flex mount and piston ball joint assembly such that these structures may move in unison and provide for improved compressor performance and effective sound dampening. The muffler may be a single piece which is inserted into the tubular piston flex mount and may snap fit with a mating feature in the piston flex mount and to lock tightly. This snap fit may be spring loaded to prevent any rattling or loosening of the suction muffler insert during operation of the compressor.

The multi-cavity muffler design is accomplished with a primary resonance chamber, secondary resonance chamber, and third resonance chamber branched off the primary inlet tube to address typical harmonics in suction pulsations. The outer plates of the muffler design may define the three separate chambers once the muffler piece is inserted into the piston flex mount. The primary chamber may have a one-quarter wavelength Helmholtz resonator frequency tuned to the primary pulsation frequency of the suction valve, with internal volume maximized to fit into the piston flex mount. The suction gas inlet tube may be sized to avoid dynamic restriction of the incoming suction gas and the muffler insert may be made from relatively flexible and ductile nylon (PA6) or any other flexible material.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A reciprocating compressor defining an axial direction and a radial direction, the reciprocating compressor comprising:

a cylindrical casing defining a compression chamber;

a piston positioned within the compression chamber and being movable along the axial direction, the piston defining a suction port for receiving a flow of gas;

a flex mount mechanically coupled to the piston, the flex mount having an inner surface that defines a suction cavity; and a suction muffler positioned at least partially within the suction cavity of the flex mount, the suction muffler comprising:

an inlet tube extending along the axial direction within the suction cavity and defining an inlet passageway configured to receive the flow of gas; and a plurality of chamber plates that extend along the radial direction from an outer surface of the inlet tube, the plurality of chamber plates and the flex mount defining a plurality of resonance chambers.

2. The reciprocating compressor of claim 1, wherein the plurality of chamber plates comprises a first chamber plate and a second chamber plate, and wherein the plurality of resonance chambers comprises a primary resonance chamber defined by the first chamber plate, the second chamber plate, the inlet tube, and the inner surface of the flex mount.

3. The reciprocating compressor of claim 2, wherein the primary resonance chamber defines a primary resonant frequency corresponding to a primary pulsation frequency of a suction valve of the reciprocating compressor.

4. The reciprocating compressor of claim 2, wherein the plurality of chamber plates comprises a third chamber plate and wherein the plurality of resonance chambers comprises an auxiliary resonance chamber defined by the second chamber plate, the third chamber plate, the inlet tube, and the inner surface of the flex mount.

5. The reciprocating compressor of claim 4, wherein the plurality of chamber plates comprises a fourth chamber plate and wherein the plurality of resonance chambers comprises a tertiary resonance chamber defined by the third chamber plate, the fourth chamber plate, the inlet tube, and the inner surface of the flex mount.

6. The reciprocating compressor of claim 3, wherein the primary resonance chamber has a one-quarter wavelength Helmholtz resonator frequency tuned to the primary pulsation frequency of the suction valve.

7. The reciprocating compressor of claim 1, wherein each of the plurality of resonance chambers are Helmholtz resonators.

8. The reciprocating compressor of claim 1, wherein the inlet tube defines a plurality of chamber ports, at least one of the plurality of chamber ports providing fluid communication between the inlet passageway and each of the plurality of resonance chambers.

9. The reciprocating compressor of claim 1, wherein each of the plurality of chamber plates extends outward from the inlet tube along the radial direction to contact the inner surface of the flex mount.

10. The reciprocating compressor of claim 1, wherein the suction muffler is injection molded from nylon, polyamide, or flexible plastic.

11. The reciprocating compressor of claim 1, wherein the flex mount defines a locking flange that extends from the inner surface of the flex mount toward the suction muffler along the radial direction, and wherein the suction muffler further comprises:

a latching feature that engages the locking flange to secure the suction muffler within the suction cavity.

12. The reciprocating compressor of claim 11, wherein the latching feature is defined on an inlet plate of the plurality of chamber plates and extends away from remaining plates of the plurality of chamber plates along the axial direction.

13. The reciprocating compressor of claim 11, wherein the latching feature defines a ramped surface for engaging the locking flange as the suction muffler is rotated, wherein the latching feature is deflected until the locking flange is seated in a locking recess defined by the latching feature.

14. The reciprocating compressor of claim 11, wherein the flex mount defines a plurality of locking flanges and the suction muffler defines a plurality of latching features.

15. The reciprocating compressor of claim 1, further comprising:

a valve positioned over the suction port for selectively permitting the flow of gas through the suction port and into the compression chamber.

16. The reciprocating compressor of claim 1, further comprising:

a motor for reciprocating a mover along the axial direction, wherein the flex mount is mechanically coupled to the mover for reciprocating the piston along the axial direction.

17. A suction muffler for a reciprocating compressor, the reciprocating compressor defining an axial direction and a radial direction, the reciprocating compressor comprising a piston positioned within a compression chamber, a flex mount mechanically coupled to a piston and having an inner surface that defines a suction cavity and a locking flange that extends from the inner surface of the flex mount toward the suction muffler along the radial direction, the suction muffler comprising:

an inlet tube extending along the axial direction within the suction cavity and defining an inlet passageway configured to receive a flow of gas;

a plurality of chamber plates that extend along the radial direction from an outer surface of the inlet tube, the plurality of chamber plates and the flex mount defining a plurality of resonance chambers; and a latching feature that engages the locking flange to secure the suction muffler within the suction cavity.

18. The suction muffler of claim 17, wherein the plurality of chamber plates comprises a first chamber plate and a second chamber plate, and wherein the plurality of resonance chambers comprises a primary resonance chamber defined by the first chamber plate, the second chamber plate, the inlet tube, and the inner surface of the flex mount.

19. The suction muffler of claim 18, wherein the primary resonance chamber defines a primary resonant frequency corresponding to a primary pulsation frequency of a suction valve of the reciprocating compressor.

20. The suction muffler of claim 17, wherein the latching feature defines a ramped surface for engaging the locking flange as the suction muffler is rotated, wherein the latching feature is deflected until the locking flange is seated in a locking recess defined by the latching feature.

* * * * *